United States Patent [19]

Langdon

[11] 4,431,379

[45] Feb. 14, 1984

[54] VALVE PISTON FOR CONSTANT DISPLACEMENT PUMP

[75] Inventor: John E. Langdon, Racine, Wis.

[73] Assignee: J. I. Case Company, Racine, Wis.

[21] Appl. No.: 332,438

[22] Filed: Dec. 21, 1981

[51] Int. Cl.[3] ..... F04B 49/00

[52] U.S. Cl. ..... 417/274

[58] Field of Search ..... 417/273, 274, 539, 212, 417/213

[56] References Cited

U.S. PATENT DOCUMENTS

| | | | |
|---|---|---|---|
| 2,423,677 | 7/1947 | Balogh | 417/274 X |
| 2,570,965 | 10/1951 | Meyers | 417/274 |
| 2,711,697 | 6/1955 | Gibbs | 417/274 |
| 2,739,643 | 3/1956 | Voit et al. | 417/274 X |
| 3,320,902 | 5/1967 | Paschke | 417/273 X |

*Primary Examiner*—Edward K. Look

*Attorney, Agent, or Firm*—Cullen, Sloman, Cantor, Grauer, Scott & Rutherford

[57] ABSTRACT

A variable volume pump for satisfying the requirements of a hydraulic system while limiting fluid flow when the full volume of fluid displacement from the pump is not required by the hydraulic system. The pump includes one or more lines of reciprocable pumping pistons mounted radially around a crankshaft. The rotation of the crankshaft results in centrifugal flow of fluid through crankpin apertures for filling the pumping pistons. Each pumping piston reciprocates within a pumping chamber and the fluid volume filling the piston is directed through a discharge port to the hydraulic system. A valve piston is mounted within the pumping chamber in spaced apart opposing relationship to the pumping piston. The valve piston is normally seated against a valve seat when the pressure level in the hydraulic system is below that necessary to reduce flow. When the pressure in the hydraulic system reaches a predetermined level, compensating pressure is communicated against the valve piston which results in the movement of the valve piston towards the pumping piston. At a maximum desired system pressure, the valve piston contacts the pumping piston and follows the pumping piston during its suction stroke thereby limiting or blocking the fluid flow out the discharge port. Thus, the fluid flow from the pump is reduced in proportion to increased system pressure until a maximum desired output pressure is reached with minimum fluid flow.

1 Claim, 3 Drawing Figures

VALVE PISTON FOR CONSTANT DISPLACEMENT PUMP

BACKGROUND OF THE INVENTION

The present invention relates to an improved fixed displacement pump arrangement for satisfying the requirements of a hydraulic system while requiring less power to operate during low demand conditions, and more particularly, to a pump construction which prevents fluid flow when the full volume of fluid displacement from the pump is not required by the hydraulic system.

It is common in earth-moving equipment, such a front end loaders, backhoes or the like, to have a bucket or a shovel mounted on a tractor to be raised and lowered, tilted, or otherwise moved into the correct attitude by an appropriate mechanism for the work being performed at the moment. Such adjustments of the bucket or shovel are commonly made by hydraulic cylinders supplied with fluid pressure from a suitable pump.

A common mode of operation in earth-working is to move a bucket or shovel into a a pile of material. The hydraulic systems for such earth-working applications require a high volume of fluid at low pressure to rapidly move the cylinder piston rods and, therefore, the bucket or shovel to the work. Then, low fluid volume under high pressure must be available to provide the necessary tilting of the bucket or shovel to break a portion of the material loose from the work pile or lift the material in the bucket or shovel.

One of the prior art approaches has been to provide a fixed displacement pump to supply the required fluid under pressure with the excess being discharged through a relief valve. It is a common arrangement to use the tractor engine for driving the pump, and the pump is normally continuously delivering its maximum amount of fluid because the tractor engine runs at a governed speed. Much of the time, the full volume of fluid is not required, and the excess fluid power must be absorbed by the system in the form of undesired heating and wear on the relief valve.

Another prior art approach has been to utilize a variable displacement pump in connection with automatic controls so that the output of the pump can be maintained at a minimum except when further output is demanded by the system. A system so equipped demands less power to operate the hydraulic system, reduces the heat rise in the fluid when operating in a low demand condition, permits a possible reduction in capacity of an oil cooler, and reduces pump and relief valve noise under low demand conditions.

A major disadvantage to the use of a variable displacement pump is cost. A variable displacement pump is significantly more expensive than a comparable fixed displacement pump, increasing the overall expense of manufacturing earth-working machines such as backhoes and front end loaders.

Thus, there has been a need for an improved fixed displacement pump arrangement which is capable of reducing excess fluid volume during low demand operation, thereby requiring less power to operate while being less expensive than a comparable variable displacement pump.

SUMMARY OF THE INVENTION

The variable volume pump of the present invention may be used with conventional earth-working equipment including front end loaders and backhoes. The pump is intended to satisfy the demands of a hydraulic system such as used in front end loaders and backhoes where a high volume of fluid is required at low pressure for rapid traverse up to the work and then low volume, high pressure fluid is required for clamping, feeding or pressing. It is understood that the pump arrangement of the present invention may be used in other environments having similar requirements.

A hydraulic system equipped with the pump arrangement of the present invention demands less power to operate and aids in the reduction of heat rise in the fluid during low demand operation.

The hydraulic pump of the present invention includes a housing with one or more lines of reciprocable pumping pistons mounted radially around a crankshaft. The crankshaft is substantially hollow and includes a number of cam lobes or crankpins. Each pumping piston is mounted on a respective crankpin by a free riding slipper. An enlarged spherical end or head with an axial drilling therethrough allows fluid flow in through the piston head for filling the piston with fluid.

The hydraulic fluid is fed through a conduit into the interior of the crankshaft. The rotation of the crankshaft results in centrifugal flow of the fluid through crankpin apertures which causes filling of the pumping pistons. As each pumping piston reciprocates, fluid under pressure is discharged to a conventional hydraulic circuit such as used in earth-working equipment.

Each pumping piston includes a cylindrical tube portion which is movable within a pumping chamber. As the pumping piston reciprocates, the fluid volume filling the tube portion is directed against a check valve. When the fluid pressure in the tube portion exceeds the preload on the check valve, the check valve is forced off its seat thereby permitting fluid to be discharged to the hydraulic system.

A valve piston is mounted in the pumping chamber in an opposing relationship to the pumping piston. The valve piston includes a cylindrical tube portion which is slidably movable within a sleeve. A spring is mounted within the tube portion in abutting engagement against a valve seat for biasing the valve piston towards the pumping piston. The lower end of the valve piston acts as a spring retainer for a return spring which is mounted within the pumping piston tube portion for holding the pumping piston in position on its slipper.

The valve piston is normally seated against its valve seat when the pressure level in the hydraulic system is below that necessary to reduce flow. Thus, the full displacement of the pumping piston passes through a discharge port into the hydraulic system for utilization as required until the pressure in the hydraulic system reaches a predetermined level where reduced flow from the pumping piston is required. When the pressure in the hydraulic system reaches this predetermined level, compensating fluid pressure is communicated into the valve piston tube portion which results in the unseating of the valve piston and compression of the pumping piston return spring by the valve piston. At a maximum desired system pressure, the valve piston contacts the pumping piston and follows the pumping piston during its suction stroke thereby blocking the fluid flow out the discharge port. Thus, the fluid flow at the discharge port is reduced in proportion to increased system pressure until a maximum desired output pressure is reached with minimum fluid flow.

The fluid pressure in the hydraulic system may be used for controlling the position of the valve piston within the pumping chamber for reducing fluid flow to the hydraulic system in proportion to increased system pressure. It is within the scope of the present invention to provide other devices for generating the control signal required for positioning the valve piston including centrifugal governors or speed control mechanisms.

Other advantages and meritorious features of the variable volume pump of the present invention will be more fully understood from the following description of the preferred embodiment, the appended claims, and the drawings, a brief description of which follows.

DETAILED DESCRIPTION OF THE INVENTION

Figure 1:
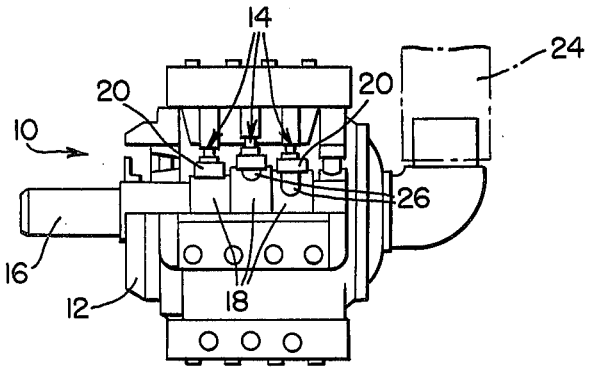
FIG. 1 is a side elevational view of the variable volume pump with a portion cut away for easier viewing.
Figure 2:
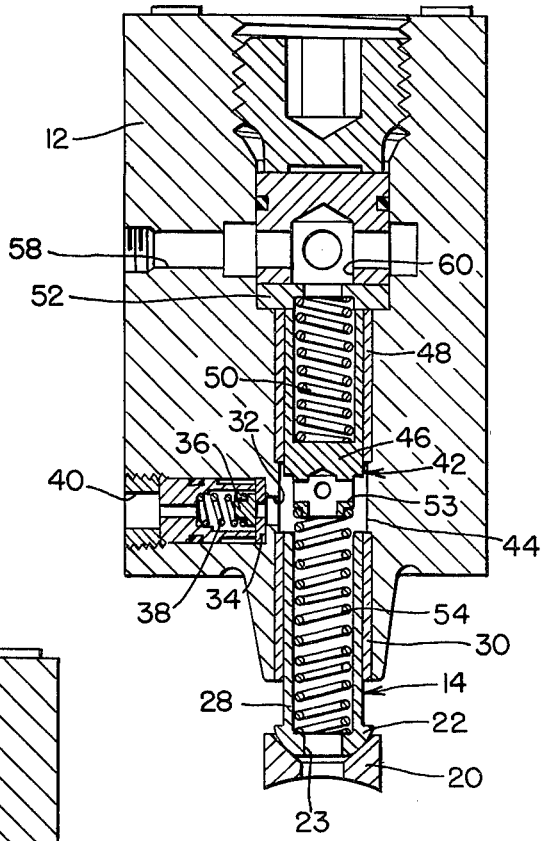
FIG. 2 is an enlarged fragmentary view of a piston assembly for the pump illustrating the valve piston in its seated position.
Figure 3:
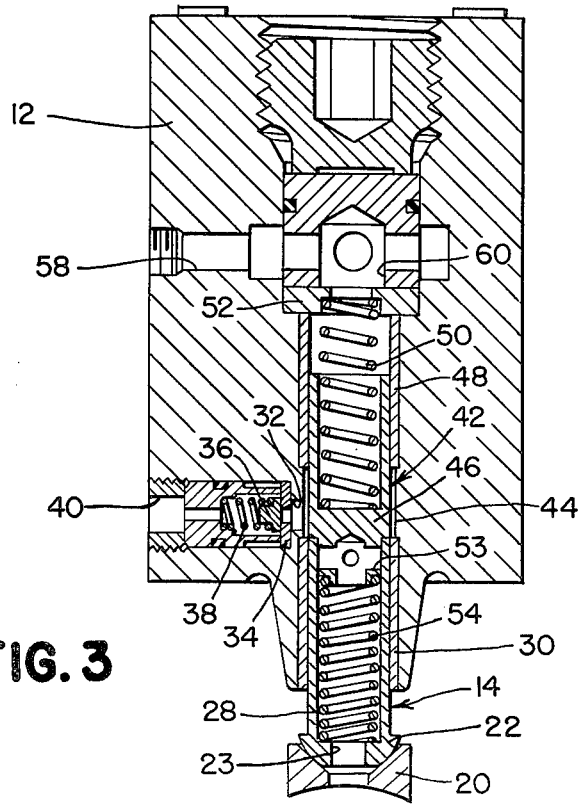
FIG. 3 is an enlarged fragmentary view of a piston assembly for the pump illustrating the valve piston in contact with the pumping piston.

A preferred embodiment of the variable volume hydraulic pump made in accordance with the teachings of the present invention is illustrated in FIGS. 1–3.

Referring to FIGS. 1–3, hydraulic pump 10 includes a housing 12 with one or more lines of reciprocable pumping pistons 14 mounted radially around a crankshaft 16. Crankshaft 16 is substantially hollow and includes a number of cam lobes or crankpins 18. Each pumping piston 14 is mounted on a respective crankpin by a free riding slipper 20. An enlarged spherical end or head 22 with an axial drilling 23 therethrough allows fluid flow in through the piston head for filling the piston with fluid.

The hydraulic fluid is fed through conduit 24 into the interior of crankshaft 16. The rotation of crankshaft 16 results in centrifugal flow of the fluid through crankpin apertures 26 which causes filling of pumping pistons 14. As each pumping piston 14 reciprocates, fluid under pressure is discharged to a conventional hydraulic circuit (not shown) such as used in earth-working equipment.

The coaction between slippers 20 and hollow crankpins 18 to effect a valving action on the suction side of pistons 14 is conventional as exemplified by U.S. Pat. No. 3,320,902 to Paschke, which includes a description of valving cooperation between a slipper and rotary drive shaft that is similar to the valving cooperation resulting between slippers 20 and crankpins 18 in pump 10.

Each pumping piston 14 includes a cylindrical tube portion 28 which is slidably movable within sleeve 30. As piston 14 moves upwardly from the position shown in FIG. 2, the fluid volume filling tube portion 28 is delivered through opening 32 in seat 34 against check valve 36. When the fluid pressure in tube portion 28 exceeds the preload of spring 38, check valve 36 is forced off seat 34 thereby permitting fluid to pass out through discharge port 40 to the hydraulic system.

A valve piston 42 is mounted in pumping chamber 44 in an opposing relationship to pumping piston 14. Valve piston 42 includes a cylindrical tube portion 46 which is slidably movable within sleeve 48. Spring 50 is mounted within tube portion 46 in abutting engagement against cover 52 for biasing valve piston 42 towards pumping piston 14. The lower end 53 of valve piston 42 acts as a spring retainer for return spring 54 which is mounted within pumping piston tube portion 28 for holding piston 14 in position on slipper 20.

Valve piston 42 is normally seated against cover 52 when the pressure level in the hydraulic system is below that necessary to reduce flow. Thus, the full displacement of pumping piston 14 passes through discharge port 40 into the hydraulic system for utilization as required until the pressure in the hydraulic system reaches a predetermined level where reduced flow from pumping piston 14 is required. When the pressure in the hydraulic system reaches this predetermined level, compensating pressure is communicated into tube portion 46 through inlet port 58 and opening 60 in cover 52 which results in the unseating of valve piston 42 and compression of pumping piston spring 54 by valve piston 42. At a maximum desired system pressure, valve piston 42 will contact pumping piston 14 as illustrated in FIG. 3 and follow pumping piston 14 during its suction stroke thereby blocking the fluid flow out discharge port 40. Thus, the fluid flow out discharge port 40 is reduced in proportion to increased system pressure until a maximum desired output pressure is reached with minimum fluid flow.

Inlet port 58 may be connected to the hydraulic system for receiving the compensating pressure necessary for actuating valve piston 42. Thus, the fluid pressure in the hydraulic system can be used for controlling the position of valve piston 42 within pumping chamber 44. It is within the scope of the present invention to provide other devices for generating the control signal required for positioning valve piston 42 including centrifugal governors or speed control mechanisms.

It will be apparent to those skilled in the art that the foregoing disclosure is exemplary in nature rather than limiting, the invention being limited only by the appended claims.

I claim:

1. A variable volume pump for satisfying the fluid flow requirements of a hydraulic system while limiting fluid flow when the full volume of fluid displacement from the pump is not required by the hydraulic system, said pump including at least one reciprocable pumping piston, said pumping piston including a tube portion which is movable within a pumping chamber, means for filling the pumping piston tube portion with fluid during a suction stroke by said pumping piston, said pumping piston being slidably mounted by a free riding slipper member on a rotatable substantially hollow crankpin having an aperture, said pumping piston including an enlarged spherical head with an axial drilling therethrough, and fluid being fed through said aperture and axial drilling into said pumping piston for filling said piston tube portion, means for dicharging the fluid filling said pumping piston tube portion through a discharge port to said hydraulic system when the fluid pressure in said hydraulic system is less than the fluid pressure in said pumping piston tube portion, a reciprocable valve piston mounted within said pumping chamber in spaced apart aligned opposing relationship to said pumping piston, said valve piston including a tube portion which is normally seated against a cover when the pressure level in said hydraulic system is below that necessary to reduce fluid flow, a spring mounted within said valve piston tube portion in abutting engagement against said cover for biasing said valve piston towards said pumping piston, spring means mounted within said pumping piston tube portion and said spring means engaging one end of said valve piston, means for communicating compensating fluid pressure through an opening in said cover and into said valve piston tube portion for unseating said valve piston when the pressure in said hydraulic system reaches a predetermined level, and said valve piston being movable towards said pumping piston for engaging and following said pumping piston during its suction stroke when the pressure in said hydraulic system reaches said predetermined level whereby said valve piston limits or blocks fluid flow out of said discharge port.

* * * * *